US005331271A

United States Patent [19]

Thuis

[11] Patent Number: 5,331,271

[45] Date of Patent: Jul. 19, 1994

[54] COMPENSATION SCHEME FOR REDUCING EFFECTIVE TRANSFORMER LEAKAGE INDUCTANCE

[75] Inventor: Robbert C. Thuis, Nijmegen, Netherlands

[73] Assignee: U. S. Philips Corporation, New York, N.Y.

[21] Appl. No.: 29,289

[22] Filed: Mar. 10, 1993

Related U.S. Application Data

[63] Continuation of Ser. No. 751,375, Aug. 28, 1991, abandoned.

[30] Foreign Application Priority Data

Feb. 13, 1991 [NL] Netherlands ..... 9100247

[51] Int. Cl.[5] ..... G05F 3/06

[52] U.S. Cl. ..... 323/355; 336/170; 343/745; 343/861; 455/292

[58] Field of Search ..... 336/170; 323/355, 356, 323/306; 455/292; 343/745, 749, 856, 860, 861

[56] References Cited

U.S. PATENT DOCUMENTS

| | | | |
|---|---|---|---|
| 1,133,750 | 3/1915 | Shaw . | |
| 1,591,660 | 7/1926 | Cory | 336/170 |
| 2,992,386 | 7/1961 | Rosin . | |
| 4,218,774 | 8/1980 | Kondo | 455/292 |

FOREIGN PATENT DOCUMENTS

| | | | |
|---|---|---|---|
| 476112 | 8/1951 | Canada | 343/861 |
| 627866 | 10/1927 | France | 323/306 |
| 786439 | 9/1935 | France | 323/306 |
| 57-196509 | 12/1982 | Japan . | |
| 45320 | 11/1961 | Poland | 323/306 |

*Primary Examiner*—William H. Beha, Jr
*Attorney, Agent, or Firm*—Edward Blocker

[57] ABSTRACT

A transformer having a core of soft magnetic material around which a first winding and a second winding are wound and a leakage inductance based on the magnetic coupling between these windings. The effective leakage reactance is minimized by adding a third transformer winding serially connected to a capacitor, the latter of which is varied to reduce the leakage reactance over a broad frequency range.

2 Claims, 2 Drawing Sheets

COMPENSATION SCHEME FOR REDUCING EFFECTIVE TRANSFORMER LEAKAGE INDUCTANCE

This is a continuation of application Ser. No. 07/751,375, filed Aug. 28, 1991 now abandoned.

BACKGROUND OF THE INVENTION

The invention relates to a transformer, comprising a core of a soft-magnetic material provided with a first winding and a second winding which is coupled thereto, each winding consisting of at least one wire-shaped conductor.

An example of such a transformer is known from PIRE 47 No. 8 (August 1959), pp. 1337-1342. In many cases it is desirable to minimize the leakage inductance of the transformer, i.e. the coupling between the windings is as high as possible. This requirement must be satisfied over a wide frequency range if the transformer is to be used in a system having a large bandwidth. The cited publication describes steps for increasing the coupling, for example the twisting of the conductors constituting the windings. Furthermore, the use of a toroidal transformer core may also contribute to increased coupling. In practice, however, it has been found that total coupling of the windings cannot be adequately approached, so that some leakage inductance is inevitable.

SUMMARY OF THE INVENTION

It is an object of the invention to provide a transformer of the kind set forth in which the effect of the leakage inductance can be eliminated over a wide frequency range. To achieve this, the transformer in accordance with the invention is characterized in that there is provided a third winding which is coupled to the first winding and the second winding and which is provided with terminals which are interconnected by means of a capacitor.

When the value of the capacitor is suitably chosen, the effect of the leakage inductance in a given frequency range can be substantially eliminated by the effect of the capacitor. To this end it may be advantageous to construct the capacitor so as to be variable.

As will be explained hereinafter, for high frequencies the capacitor may be assumed to be connected in series with the leakage inductance and a load connected to the second winding. In that case it is advantageous when the number of turns of the third winding equals that of the second winding. The capacitor then has its actual value in the series connection, rather than a value increased or decreased by transformation.

A preferred embodiment of the transformer in accordance with the invention is characterized in that the conductors constituting the first, the second and the third winding are twisted over at least a part of their length. As is known per se, this step increases the coupling between the windings, so that on the one hand the leakage inductance to be compensated by means of the capacitor is minimized while on the other hand the capacitor is connected as effectively as possible in series with the leakage inductance and the load.

BRIEF DESCRIPTION OF THE DRAWINGS

The invention will be described in detail hereinafter with reference had to the following description taken in connection with the accompanying drawings in which.

DESCRIPTION OF THE PREFERRED EMBODIMENTS

Figure 1:
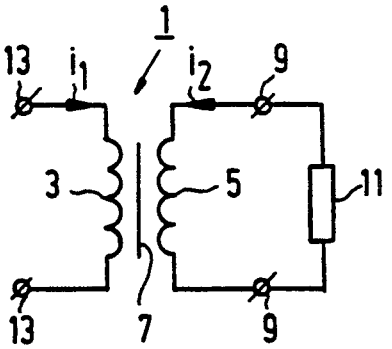
FIG. 1 PRIOR ART
FIG. 1 shows a circuit diagram of a conventional transformer and a load connected thereto.

FIG. 1 shows a circuit diagram of a known transformer 1, comprising a first winding 3 and a second winding 5 which are provided on a core 7 of a soft-magnetic material, for example ferrite. A load 11 is connected to the second winding 5 via output terminals 9. The first winding 3 is connected to input terminals 13. When the current in the first winding 3 equals $i_1$ at a given instant and that in the second winding 5 equals $i_2$, the magnetic flux in the first winding and the second winding being equal to $\Phi_1$ and $\Phi_2$, respectively, the following relation holds good:

$$M = \frac{d\Phi_2}{di_1} = \frac{d\Phi_1}{di_2} = K\sqrt{L_1L_2}$$

Figure 2:
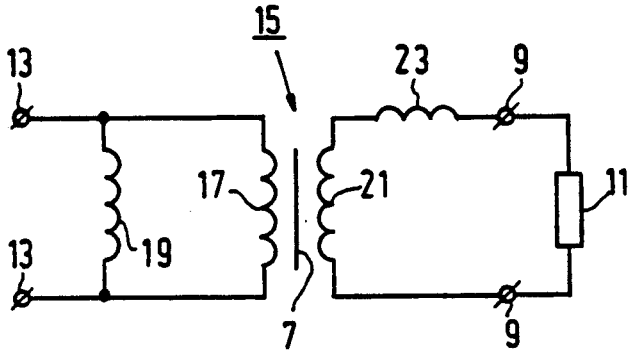
FIG. 2 PRIOR ART
FIG. 2 shows an equivalent diagram of the transformer shown in FIG. 1.

Therein, M is the mutual inductance of the two windings, K is the coupling factor, and $L_1$ and $L_2$ are the inductance of the first and the second winding, respectively. For an ideal transformer, $K=1$. In practice, however, K is always smaller than 1 because the coupling between the two windings is not perfect. In the equivalent diagram of FIG. 2 the transformer 1 is shown as an ideal transformer 15, comprising a first winding 17 whereto a coil 19 having an inductance $L_1$ is connected in parallel, and a second winding 21 with which a coil 23 is connected in series. The coil 23 represents the effect of the coupling factor K. Its inductance $L_s$ equals $L_2(1-K^2)$. This is referred to as the leakage inductance. The ideal transformer 15 has a coupling factor K equal to 1 and a transformation ratio equal to $L_1/M:1$. If the load is, for example a resistance R, the conductance Y measured between the input terminals 13 will be:

$$Y = \frac{RM^2}{R^2L_1^2 + \omega^2L_1^2L_2^2(1-k^2)^2} - j\left(\frac{\omega L_2M^2(1-K^2)}{R^2L_1^2 + \omega^2L_1^2L_2^2(1-K^2)^2} + \frac{1}{\omega L_1}\right)$$

Therein, $\omega=2\pi f$, where f is the frequency of a sinusoidal alternating voltage applied to the input terminals 13. It appears from the foregoing formule that the conductance Y decreases as the frequency f increases. This decrease is greater as K is smaller. The variation of Y is liable to cause reflections because at higher frequencies the impedance of the circuit formed by the transformer with the load R deviates increasingly from the impedance of a source connected to the input terminals 13, for example a conductor of a central antenna system.

Figure 3:
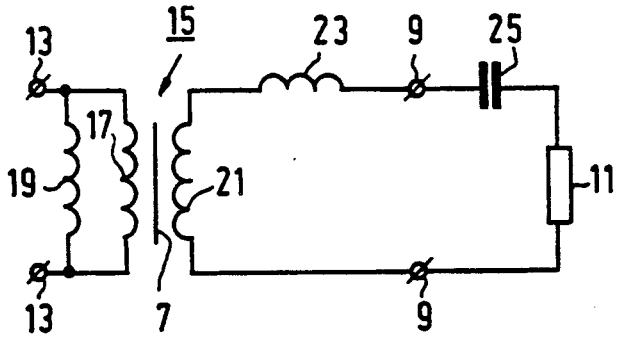
FIG. 3 shows an equivalent diagram of a modified version of the transformer shown in FIG. 1.

The effect of the leakage inductance can in principle be reduced by connecting a suitable capacitor 25 in series with the coil 23 as indicated in the equivalent diagram of FIG. 3. The value $C_s$ of the capacitor 25 is chosen so that for a given frequency $f_0$:

$$\omega_0^2 L_s C_s = 1$$

Figure 4:
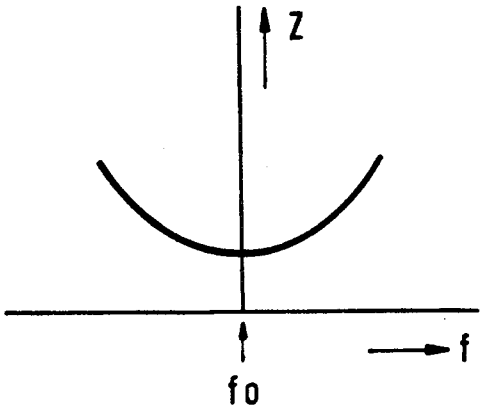
FIG. 4 shows a diagram illustrating the operation of the modification shown in FIG. 3.

For the frequency $f_0$ the impedance measured across the input terminals 13 then equals R if the transformer 15 has a transformation ratio 1:1. The variation of the impedance $Z=1/Y$ as a function of the frequency f is shown in FIG. 4. It appears from this Figure that the impedance has a minimum value R for the chosen frequency $f_0$ and increases for higher and lower frequencies. This is undesirable if the circuit is to operate correctly also at comparatively low frequencies. Therefore, in such circumstances the described solution, utilizing a capacitor 25 connected in series with the load 11, cannot be used.

Figure 5:
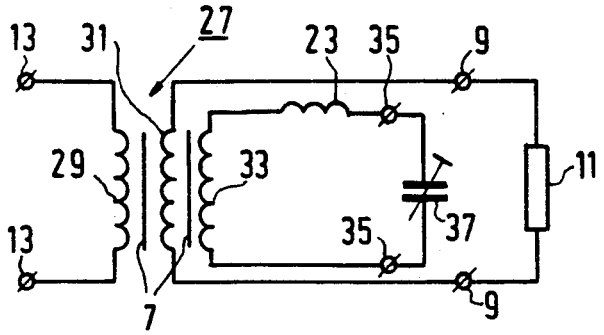
FIG. 5 shows an equivalent diagram of an embodiment of a transformer in accordance with the invention.

FIG. 5 shows a diagram of a transformer 27 which does not have the described drawbacks. In addition to a first winding 29 and a second winding 31, the transformer 27 comprises a third winding 33 which is provided with connection terminals 35 which are interconnected by means of a capacitor 37 which is preferably variable as shown. The coupling between the three windings 29, 31 and 33 is as high as possible, thus minimizing the leakage inductance. Because the capacitor 37 is connected to the third winding 33, it is not connected in series with the load 11 for low frequencies, so that the input impedance of the transformer measured across the input terminals 13 does not increase for low frequencies. For high frequencies, however, the capacitor 37, the load 11 and the leakage inductance 23 may be assumed to be connected in series. By adjustment of the value of the capacitor, the input impedance of the transformer measured across the input terminals equals R (provided that the transformation ratio is 1:1). Thanks to the high coupling between the three windings, the value of the leakage inductance $L_s$ is very low, so that the circuit quality $\omega_0 L_s/R$ is also very low. Consequently, the leakage inductance compensation introduced by the capacitor 37 is effective over a comparatively wide frequency range.

Figure 6:
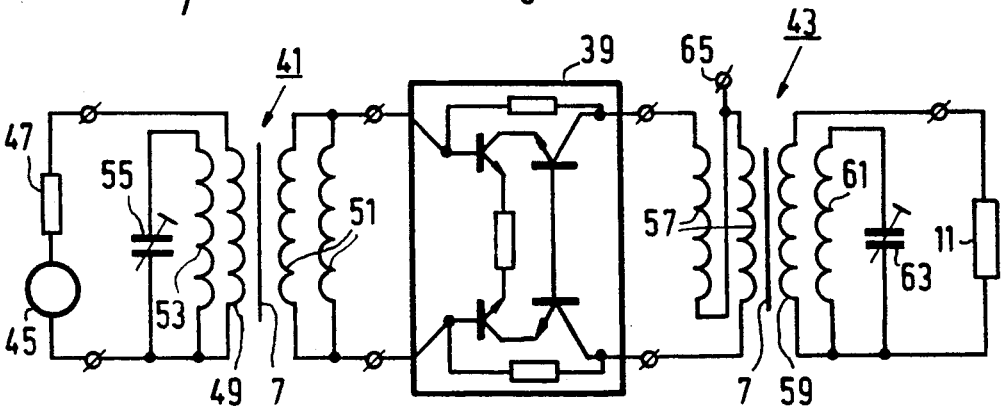
FIG. 6 shows a circuit diagram of a circuit in which two embodiments of the transformer in accordance with the invention are used.

FIG. 6 shows an example of a circuit utilizing two transformers whose leakage inductance is compensated for in the manner described with reference to FIG. 5. The circuit comprises a module 39 for a central antenna system which is coupled to the system via an input transformer 41 and an output transformer 43. The load 11 represents the outgoing cable system. The incoming antenna system is represented as a voltage source 45 having an internal impedance 47. The input transformer 41 comprises a primary winding 49, a secondary winding 51 and a compensation winding 53 whereto a variable capacitor 55 is connected. The transformation ratio is not equal to 1 (for example 6:5) and in order to reduce the leakage inductance the secondary winding is composed of two wire-shaped conductors in the manner described in the previous Netherlands Patent Application 90 02 005 (PHN 13.437). The compensation winding 53 comprises the same number of turns as the primary winding 49. The conductors constituting the windings are twisted over an as large as possible part of their length in order to maximize the coupling between the windings. The output transformer 43 comprises a primary winding 57, a secondary winding 59 and a compensation winding 61 whereto a variable capacitor 63 is connected. The secondary winding 59 and the compensation winding 61 comprise the same number of turns and the primary winding 57 consists of two series-connected sub-windings provided with a central tapping 65 whereto a direct voltage can be applied in order to power the module 39.

Figure 7:
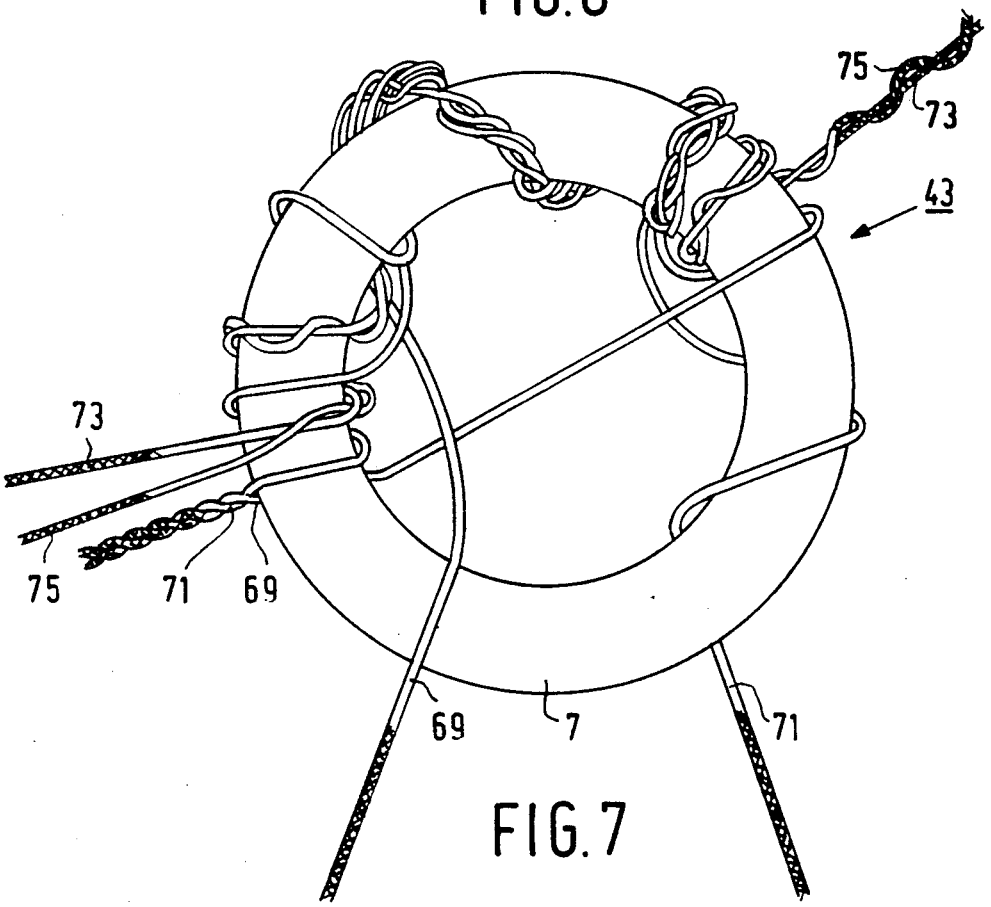
FIG. 7 shows the construction of an embodiment of the transformer in accordance with the invention.

The construction of the output transformer 43 is shown in FIG. 7. The output transformer 43 comprises a toroidal core 7 of ferrite on which four wire-shaped conductors 69, 71, 73 and 75 which have been twisted as far as possible are wound. The conductors 69 and 71 constitute the primary winding 57; the conductor 73 constitutes the secondary winding 59 and the conductor 75 constitutes the compensation winding 61. The insulation has been removed from the free ends of the conductors 69–75 and these ends have been coated with tin.

I claim:

1. A method of operating a transformer within at least a high frequency range relative to a lower frequency range and having a first winding, a second winding and a third winding, each winding having a conductor twisted over at least a portion of its length with each of the other conductors and a variable capacitor connected across said third winding and characterized by an input impedance and a leakage inductance, said method comprising the steps of:

selecting a frequency within the high frequency range; and adjusting the capacitance of the variable capacitor based on a measured input impedance to minimize the leakage inductance at that selected frequency.

2. The method of claim 1, further including the input impedance of the transformer across the first winding.

* * * * *